US006266886B1

(12) United States Patent
Tandart

(10) Patent No.: US 6,266,886 B1
(45) Date of Patent: Jul. 31, 2001

(54) HYDRAULIC PUNCH

(75) Inventor: Jean Marie Tandart, Epernay (FR)

(73) Assignee: FACOM, Morangis (FR)

( * ) Notice: Subject to any disclaimer, the term of this patent is extended or adjusted under 35 U.S.C. 154(b) by 0 days.

(21) Appl. No.: 09/449,483

(22) Filed: Nov. 29, 1999

(30) Foreign Application Priority Data

Nov. 30, 1998 (FR) ..... 98 15080

(51) Int. Cl.[7] ..... B21D 28/24; B26F 1/02

(52) U.S. Cl. ..... 30/360; 30/361; 30/362; 30/363

(58) Field of Search ..... 30/272.1, 358, 30/360, 361, 362, 363; 81/177.7, 177.8; 173/171

(56) References Cited

U.S. PATENT DOCUMENTS

| | | | | |
|---|---|---|---|---|
| 3,564,716 | * | 2/1971 | Burrows | 30/360 |
| 3,571,874 | | 3/1971 | Von Arx . | |
| 4,922,615 | | 5/1990 | Nishida | 30/360 |
| 5,515,754 | * | 5/1996 | Elkins | 81/177.7 |

FOREIGN PATENT DOCUMENTS

| | | |
|---|---|---|
| 4-305325 | 10/1992 | (JP) . |
| 5-76956 | 3/1993 | (JP) . |
| 7-080564 | 3/1995 | (JP) . |
| 7-80566 | 3/1995 | (JP) . |
| 95/05924 | 3/1995 | (WO) . |

* cited by examiner

*Primary Examiner*—Hwei-Siu Payer
(74) *Attorney, Agent, or Firm*—Wenderoth, Lind & Ponack, LLP.

(57) ABSTRACT

A hydraulic punch (1) having a hydraulic ram (2) and a hydraulic pump (3). The hydraulic pump having a body (4) and a reservoir having a longitudinal axis (XX) being secured to the ram and equipped with a manual operating lever (12). The ram is articulated to the pump body about an axis of rotation (ZZ) which is inclined with respect to the longitudinal axis (XX) of the pump reservoir. The ram (2) has a cylinder (7) containing a piston (8) and a ram end (9) forming a connection with the body (4) of the pump (3) to which it is rotatably articulated. An indexing device such as a ball (15) pushed by a spring and housed in indentations in the body (4) or in the ram end (9) allow the ram (2) to be kept in a chosen angular position (parallel or perpendicular) with respect to the pump (3). Furthermore, a longitudinal pull axis (YY) of the ram (2) is offset laterally from and parallel to the longitudinal axis (XX) of the reservoir of the pump (3). Because the ram (2) can be orientated with respect to the pump (3), this punch alone can replace the two tools which were previously needed.

16 Claims, 4 Drawing Sheets

HYDRAULIC PUNCH

FIELD OF THE INVENTION

The subject of the present invention is a hydraulic punch of a type comprising a hydraulic pull ram, a hydraulic pump comprising a body and a reservoir of longitudinal axis secured to the ram and equipped with a manual operating lever.

A tool of this kind allows holes to be pierced in sheet metal or possibly in sheets of other materials, for example in the walls of electrical cabinets, in preparation for the subsequent mounting of various components on this sheet.

To this end, the ram piston has a tapped axial hole opening into a tip of the ram and into which a threaded rod can be screwed. A die is then mounted on the rod. The rod is then inserted through a hole of a corresponding diameter already made in the metal sheet using a drill. Once this operation has been performed, a punching tool is screwed onto that end of the threaded rod which protrudes from the metal sheet, until the punching tool comes into contact with the metal sheet. The pivoting of the operating lever actuates the ram, whose pulling force on the piston pulls the punching tool through the metal sheet, making therein an opening which corresponds to the outline of the punching tool.

BACKGROUND OF THE INVENTION

There is known a first embodiment of a punch in which a ram extends along a pull axis which is practically coincident with a longitudinal axis of a pump reservoir, the punch as a whole being straight. In a second known embodiment, the ram is arranged with its pull axis perpendicular to the longitudinal axis of the pump reservoir. The operator chooses the more appropriate punch according to the accessibility of the hole that he has to make.

Thus, according to this known prior art, it is necessary to have two punches, each having a given orientation of the ram with respect to the longitudinal axis of the pump, which leads to high expenditures on the appropriate tools. Furthermore, when using the straight tool to make holes near an end of a cabinet or near another wall, the operator cannot get his hand between the pump and the end or the contiguous wall, and this hampers him in his use of the tool.

In another known embodiment, the pump body is connected to the ram by an elbowed connector, one end of which is articulated with respect to the pump body about an axis which is coincident with the longitudinal axis of the pump, and the other end of which is articulated with respect to the ram about an axis which is perpendicular to the previous axis. The ram can thus be orientated about two perpendicular axes.

This tool has a relatively complicated structure, particularly since the connector is outside of the ram and consists of a relatively high number of parts. Furthermore, at each of the hydraulic connections between the ends of the connector, and on the one hand, the pump body and, on the other hand, the ram, it is necessary to ensure the continuity of the hydraulic circuit. This arrangement therefore demands numerous fastening and sealing elements which increase the complexity of the assembly. Finally, the connector has an elbowed shape, to one of the ends of which the ram is rotatably articulated, and this makes the tool vulnerable to impact, for example if dropped, which is likely to corrupt the articulation of the ram to the connector.

SUMMARY OF THE INVENTION

The object of the invention is to provide a punch which can be used either with its ram in line with the pump or in a configuration in which it forms an elbow therewith, for example being perpendicular thereto.

As an additional feature, the invention also intends to arrange the tool in such a way as to allow the operator to operate it normally when the hole is to be made in a place which is difficult to access, particularly in close proximity to another wall.

According to the invention, the hydraulic punch is characterized in that the ram is articulated with respect to the pump body about an axis of rotation which is inclined with respect to the longitudinal axis of the pump reservoir.

Thus, rotating the ram about its axis of articulation allows it to be orientated in the most appropriate configuration with respect to the longitudinal axis of the pump, either in line with or inclined to the longitudinal axis of the pump.

The inclination of the axis of rotation of the ram to the pump body can vary. As a preference, according to one feature of the invention, this inclination is approximately 45 degrees.

With a 45-degree inclination, rotating the ram 180 degrees allows it to be changed from a first position, in which it is approximately in line with the longitudinal axis of the pump reservoir, into a second position, in which its pull axis is approximately perpendicular to the axis of the said reservoir.

A punch of this kind therefore advantageously replaces the two separate tools which were needed in the prior art. According to another advantageous feature of the invention, the longitudinal pull axis of the ram is aligned with the longitudinal axis of the pump reservoir and offset parallel thereto.

This particular feature allows the operator, when the ram extends parallel to the axis of the pump reservoir and is resting against a wall parallel to this reservoir, to slip his fingers around the pump in the space which is thus available. The operator can thus use the punch conveniently when the hole needs to be made in a place to which access is difficult.

The invention will now be described with reference to the appended drawings which illustrate two embodiments thereof by way of non-limiting examples. FIG. 1 is an elevation on a reduced scale of a first embodiment of the hydraulic punch according to the invention, in a position for piercing a hole in a metal sheet.

DETAILED DESCRIPTION OF THE INVENTION

Figure 1:
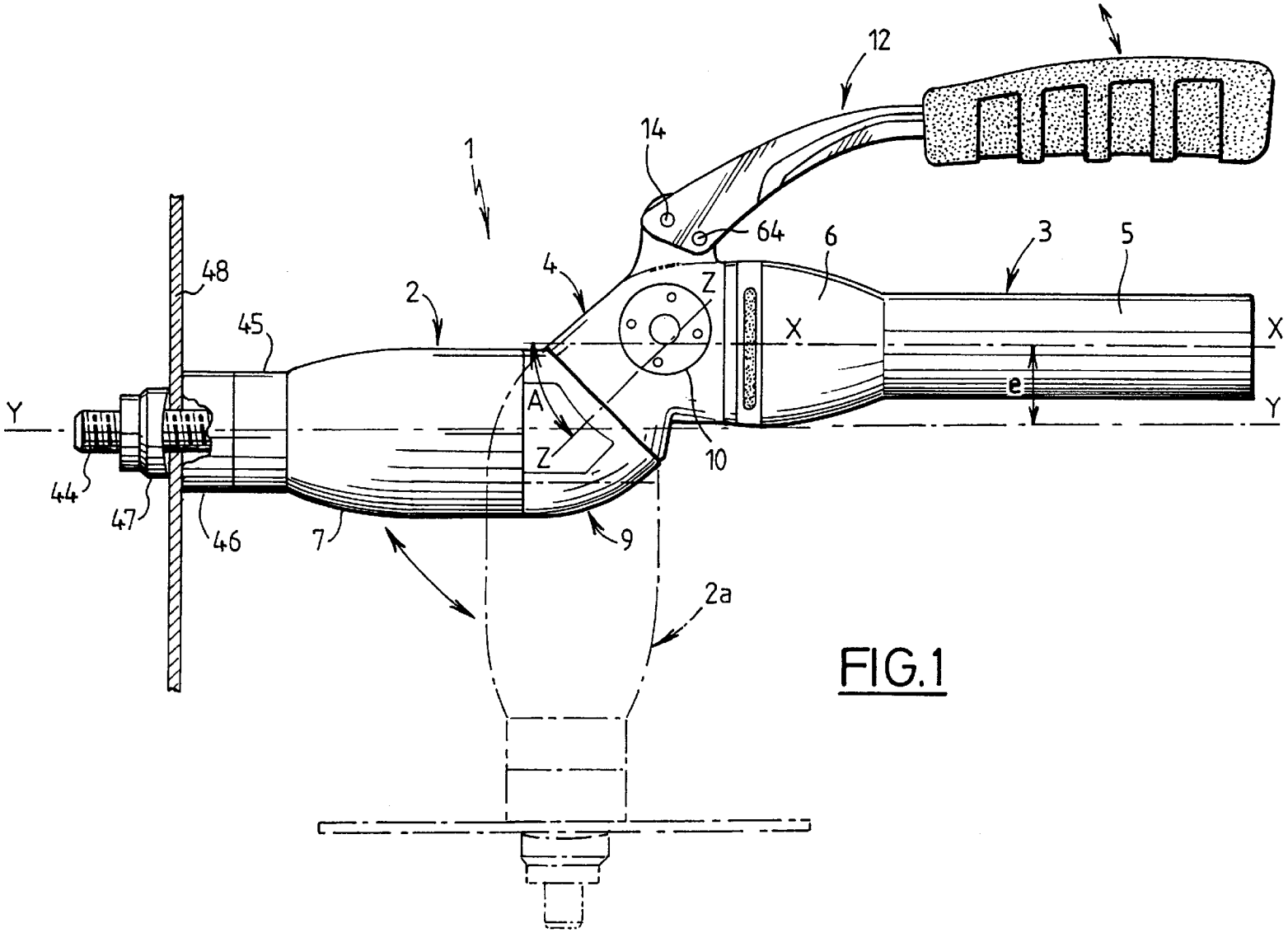
FIG. 1 is an elevation on a reduced scale of a first embodiment of the hydraulic punch according to the invention, in a position for piercing a hole in a metal sheet.
Figure 2:
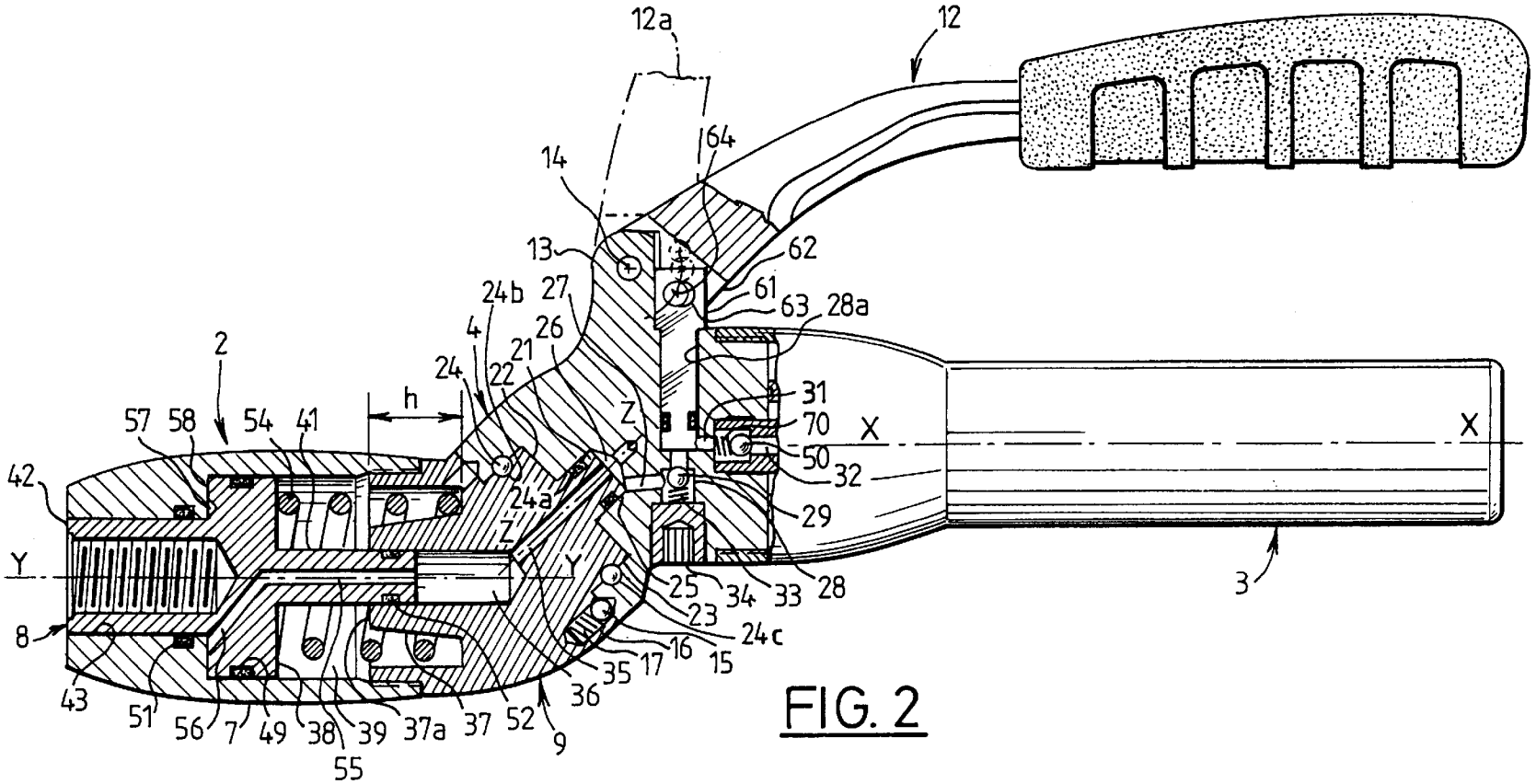
FIG. 2 is a view partly in elevation and partly in longitudinal section, on a reduced scale, of the punch of FIG. 1 in its configuration in which the ram is orientated with its pull axis parallel to the longitudinal axis of the pump reservoir.
Figure 3:
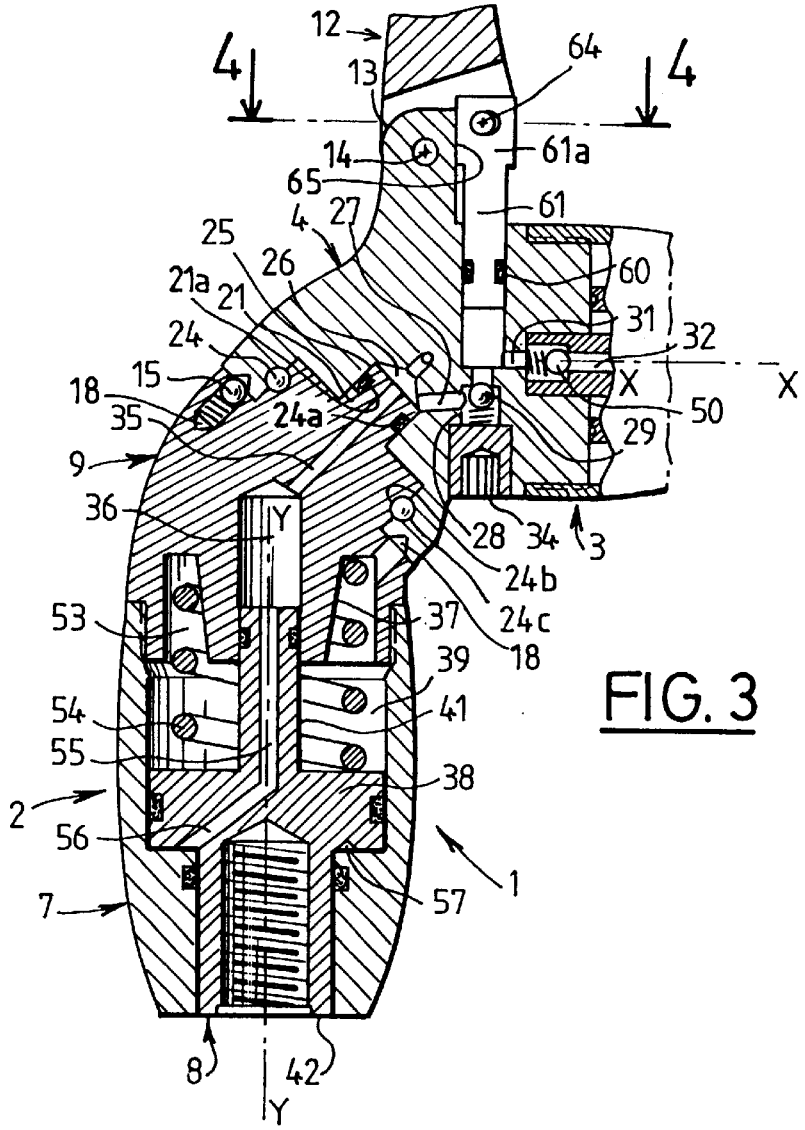
FIG. 3 is a part view in longitudinal section similar to FIG. 2 of the punch in its configuration in which, after rotation, the ram is orientated so that it is perpendicular to the longitudinal axis of the pump reservoir.
Figure 4:
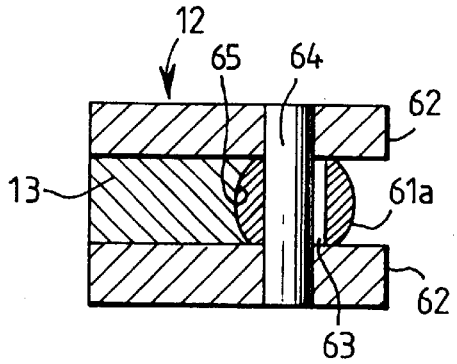
FIG. 4 is a view in section of 4/4 of FIG. 3.

The hydraulic punch 1 illustrated in FIGS. 1 to 3 comprises a hydraulic pull ram 2,—a hydraulic pump 3 comprising a body 4 and, as is known, a reservoir containing a hydraulic fluid. This reservoir is arranged inside a rigid tubular sleeve 5 which acts as a handle, a widened end 6 of which can be screwed onto the pump body 4. The reservoir and the tubular sleeve 5 extend along a longitudinal axis XX.

The hydraulic ram 2 consists of a cylinder 7 containing a piston 8 mounted to slide along a longitudinal axis YY, and of a ram end 9 to one end of which the cylinder 7 can be attached, for example by screw fastening. The end 9 of the ram is articulated directly to the pump body 4 about an axis of rotation ZZ which is inclined with respect to the longitudinal axis XX of the reservoir of the pump 3. This inclination A can vary greatly. Advantageously, the angle of inclination A may be 45 degrees (position 2*a*), as depicted partially with a chain line. Furthermore, the ram end 9 and the pump body 4 are shaped in such a way that the longitudinal pull axis YY is offset laterally, by a distance e from the longitudinal axis XX of the reservoir and is parallel thereto.

A lever 12 for manually operating the pump 3 is articulated to a lateral lug 13 which is of one piece with the pump body 4 of which it thus forms a part, about a pivot pin 14. The operating lever 12 can pivot about the pin 14 between two extreme positions, namely a first position in which it extends more or less parallel to the axis XX of the reservoir, and a second position 12*a* depicted partially with a chain line (FIG. 2), in which the lever 12 is approximately perpendicular to axis the XX, and the function of which will be explained later.

The ram 2 is fitted with means for indexing its angular position on the pump body 4. In the embodiment illustrated in the drawings, these indexing means comprise at least one ball 15 which can slide in a blind hole 16 in the ram end 9 forming a connection with the body 4. The hole 16 contains a spring 17 for pushing the ball 15 into one of at least two indentations 18, preferably with a V profile, formed in the end face of the pump body 4 in contact with the corresponding face of the ram end 9. The two indentations 18 are separated by an angular spacing which is such that when the ball 15 is in one of the indentations 18, the ram 2 extends more or less parallel to the longitudinal axis XX of the reservoir of the pump 3, and such that when the ball 15 is in the second indentation 18 (FIG. 3), after the ram 2 has been rotated about the axis ZZ, the latter is approximately perpendicular to the longitudinal axis XX of the pump 3. For an inclination A of 45°, the two indentations 18 are an angle of 180° apart and the ram 2 covers a half circumference from one position 2 to the other 2*a* (FIG. 1).

In each of these two positions, the spring 17 keeps the ball 15 partially engaged in the indentation 18 and in the hole 16 and therefore maintains the relative angular position of the pump body 4 and of the connection consisting of the ram end 9. When the ram 2 is turned about the axis ZZ, the ball 15 retracts into the hole 16 against the return force of the spring 17 until it comes to face the second indentation 18, into which it is partially inserted by the spring 17.

The ram end 9 comprises a male part coaxial with the axis of articulation ZZ and formed, in the example described, of a circular cylindrical central stub 21 projecting from a radial shoulder 22 concentric with the stub 21, the radial face of the shoulder 22 being extended by a circular cylindrical wall 23 of circular cross section and which is concentric with the stub 21. The central stub 21 has a groove 21*a* containing an O-ring 24*a* which provides sealing. The cylindrical surface of the stub 21 is parallel to the axis ZZ. The wall 23 has a groove 24*b* containing a ring of balls 24 constituting means of assembling the ram 2 with the pump body 4, a complementary groove 24*c* being provided for this purpose in the body 4. The stub 21 is engaged in a complementary female part of the pump body 4, forming a housing 25 inside which the stub 21 can rotate about the axis ZZ. Advantageously, the diameter of the stub 21 is smaller than the diameter of the cylindrical wall 23.

In effect, to limit the force of the pressure of the hydraulic fluid on the end 9 of the ram, the cross section of the stub 21 needs to be as small as possible. To spread this force on the assembly fastening between the ram end 9 and the pump body 4, the ring of balls has to comprise the greatest possible number of balls and, for this reason, has a cross section of large diameter, the diameter being greater than that of the stub 21.

The housing 25 delimits, with the end of the male part consisting of the stub 21, a hydraulic chamber 26 which communicates with the bore 27 connecting with the hydraulic circuit of the pump 3. The bore 27 opens into a transverse duct 28 in the body 4 which communicates with another bore 31, itself opening axially into an axial duct 32 which is the inlet to the reservoir of the pump 3. Arranged in the duct 28 is a delivery valve consisting of a ball 29 urged by a spring 33 resting against a lateral stopper 34 screwed into the pump body 4. The ball 29 is pushed by the spring 33 to rest against an annular seat of the duct 28, which it blocks off as long as the hydraulic pressure from the pump 3 is not high enough to push the ball 29 off its seat.

The hydraulic chamber 26 also communicates with a bore (passage) 35 formed axially in the stub 21. The passage 35 itself opens into a central bore 36 of an axial boss 37 in the ram end 9, arranged coaxial with the pull axis YY of the ram 2. The piston 8 consists of a central body 38 mounted to slide in a chamber 39 of the cylinder 7, of a stem 41 coaxial with the axis YY and arranged to slide with sealing in the bore 36, and finally a cylindrical end cup 42 extending on the opposite side of the body 38 to the stem 41.

This cylindrical part 42 is tapped and opens axially to the outside of the ram 2 and is mounted to slide in a cylindrical opening 43 of the ram 2. The body 38, the cylindrical part 42 and the stem 41 are of one piece. The cylindrical cup 42 can take a threaded rod 44 on which can be mounted an insert piece 45 and a die 46 resting against the tip of the cylinder 7, and a cylindrical punching tool 47. The threaded rod 44 passes through a hole of the same diameter already drilled in the sheet 48, which is inserted between the die 46 and the punching tool 47, the outline of which determines that of the hole to be made in the sheet 48.

Sealing of the body 38, of the cylindrical part 42 and of the stem 41 of the piston relative to the cylinder 7 and to the ram end 9 is provided by means of 30 O-rings 49, 51 and 52. The inlet to the reservoir of the pump 3 is normally shut off by an intake valve consisting of a ball 50 loaded by a spring 70 which pushes it onto the inlet seat of a bore 32. The latter, which opens into the reservoir, is thus closed off.

Delimited between the boss 37 and the wall of the ram end 9 is an annular housing 53, the bottom of which forms a seat for a helical spring 54 for returning the piston 8. The spring 54 is coaxial with the stem 41 and exerts its pressure on the body 38 of the piston 8. The height h of the annular housing 53 is approximately equal to that of the spring 54 when the latter is compressed by the piston 8 whose body 38, at the end of the pull stroke, comes into abutment against the end face 37*a* of the boss 37.

Formed in the stem 41 is an axial bore 55 which opens into the hydraulic chamber 36. The opposite end of the bore 55 communicates with a lateral bore 56 which itself opens into an annular hydraulic chamber 57 formed in the face of the body 38 concentric with the end part 42 and which can come into abutment against an annular shoulder 58 of the cylinder 7 forming the end of the chamber 39.

The lever 12 for manually operating the hydraulic pump 3 is articulated, in addition to being articulated to the lug 13, to a piston 61 mounted to slide in a sealed fashion by virtue of an O-ring 60, in a transverse bore 28*a* formed in the pump body 4 coaxial with the bore 28 and opening to the outside of the body 4 opposite the end of the lever 12. For this purpose, the lever has an end yoke, the arms 62 of which are connected by a pin 64 passing through an oblong slot 63 formed in the piston 61 parallel to the longitudinal axis XX. During pivoting movements of the lever 12 about the pivot pin 14, the pin 64 can therefore move back and forth in translational movement in the slot 63 (FIG. 3). Thus, when the lever 12 is in the lowered position, more or less parallel to the longitudinal axis XX of the pump 3, the pin 64 is in abutment against that side of the slot 63 which is closest to the pin 14. When the lever 12 is pivoted to raise it into a position 12*a* approximately perpendicular axis XX, the pin or journal 64 moves in the slot 63 as far as the end furthest from the pin 14. This occurs when the pins 14 and 64 are aligned on a line parallel to the axis XX. The pin 64 returns to its initial position at the end of the travel of the lever 12. These positions of the pin 64 are illustrated in FIG. 2.

The lateral lug 13 comprises an abutment surface 65 on its surface facing the head 61 a of the piston 61. At least when the lever 12 is in its position of maximum separation from the pump 3, the head 61*a* of the piston 61 is in abutment against the surface 65. The advantage of this arrangement lies in the fact that the piston 61 is in direct abutment against the pump body 4, without the intermediacy of a part such as the lever 12.

The way in which the punch 1 works is as follows.

When the lever 12 moves from a position parallel to the axis XX to a position perpendicular to the axis XX, that is to say during the upward movement of the pump piston 61, brought about by the upward pivoting of the lever 12, the delivery valve 29 is closed, and the hydraulic fluid is drawn into the reservoir via the bore 32, the valve 50 and the bore 31.

When the lever 12 moves from a position perpendicular to the axis XX to a position parallel to the axis XX, that is to say during the downward movement of the pump piston 61, the intake valve 50 is closed. The hydraulic fluid is delivered to the ram 2 by the delivery valve 29, the bore 27, the chamber 26 and the rest of the hydraulic circuit as far as the chamber 57. Thus, in the first position (FIG. 2), the piston 61 is at bottom dead center, it is at the end of its delivery and the start of its intake; in the second position 12*a* of the lever 12 (FIG. 3) (top dead center), the piston 61 is at the end of its intake and the beginning of its delivery. A series of movements of the lever 12 corresponding to successive upward and downward movements of the piston 61 are needed to fill the chamber 57 with pressurized hydraulic fluid.

As soon as the hydraulic pressure in the chamber 57 becomes higher than the opposing force of the return spring 54, the piston 8 moves away from the end 58, gradually compressing the spring 54. At the end of its pull stroke, the body 38 comes into abutment with the end face 37*a* of the boss 37, compressing the spring 54, which is then entirely contained in the housing 53.

During this pull stroke, the threaded rod 44 secured to the piston 8 is carried along by this piston, and this causes a hole corresponding to the outline of the punching tool 47 to be punched in the sheet 48.

When this hole has been punched, the hydraulic fluid is delivered in the opposite direction to the previous direction as far as the chamber 26 and from there it is returned to the hydraulic reservoir by delivery circuit means known per se and not depicted, with the exception of an operating knob 10 fixed on the body 4 (FIG. 1).

Before being used again, the operating knob 10 has to be operated to close the return circuit and the punching tool 47 has to be removed from the threaded rod.

The operation just described is obviously the same in both the depicted orientations of the ram 2 with respect to the pump 3. An essential advantage of the punch 1 according to the invention lies in the orientability of the hydraulic ram 2 between at least two possible positions with respect to the pump 3, which allows it to replace the two separate tools which were previously needed. Of course, the number of angular positions of the ram 2 with respect to the pump 3 may be higher than two, the indexing means being adapted accordingly. For example, if there were the desire to have three possible orientations, then three appropriately positioned indexing indentations 18 would be needed.

Furthermore, the offset e between the two axes XX and YY, the size of which may vary, allows the tool to be operated more conveniently by the operator in places to which access for making holes is difficult, as already mentioned.

The number of parts which make up-this punch is low compared with the prior-art embodiment described previously, in which an elbowed connector is inserted between the pump and the ram. Specifically in the punch according to the invention, the ram is articulated directly to the pump body 4, by its end 9 which forms a coupling with the pump, this reducing the number of parts needed. Furthermore, the tool thus becomes more compact and more resistant to impact, since the pump body 4 can have an appropriate shape consisting of a casting or a forging which is then machined. The sealing means are also simplified by reducing the number of O-rings needed.

Figure 5:
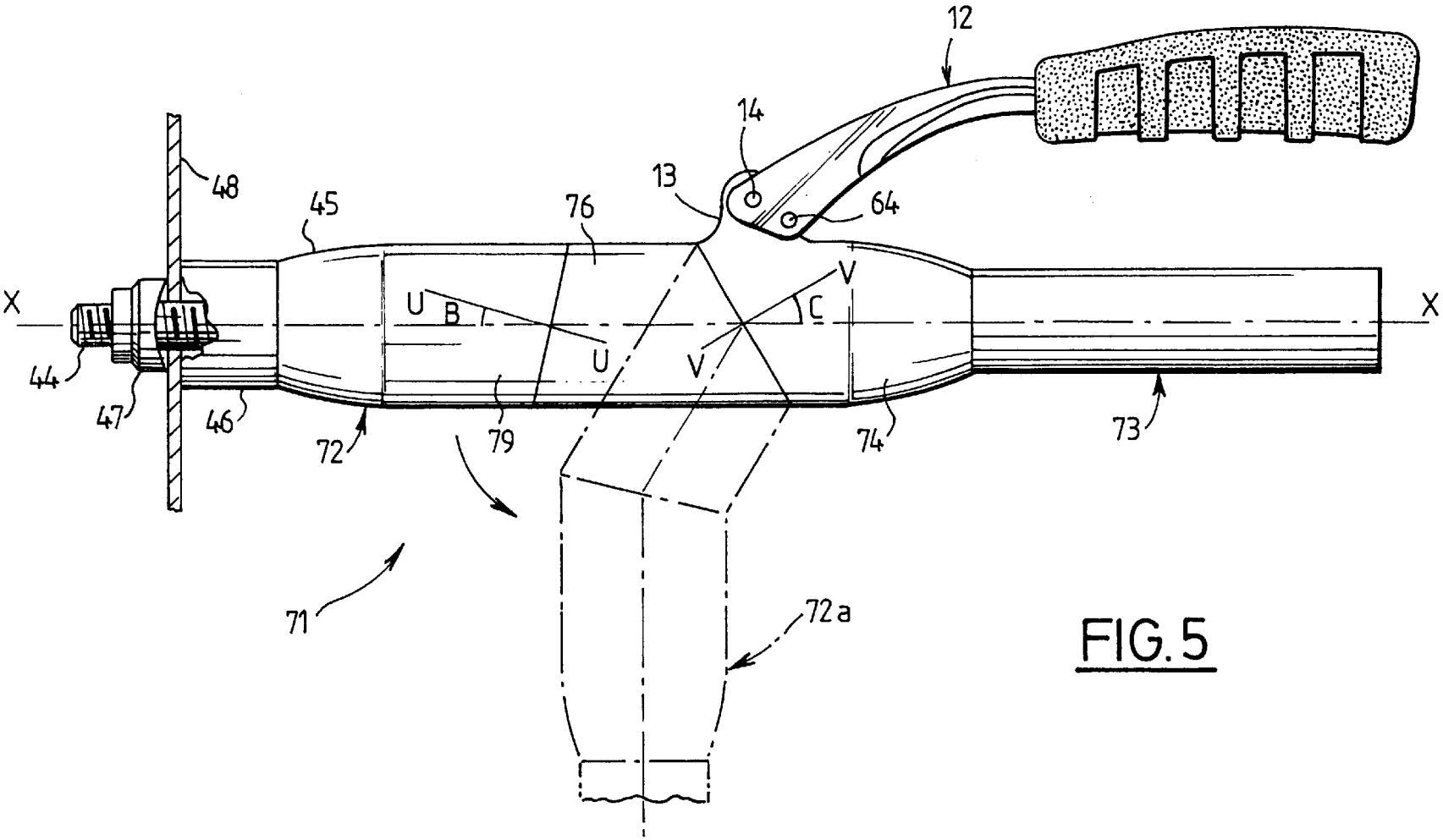
FIG. 5 is a view in longitudinal elevation of a second embodiment of the punch according to the invention.

In the second embodiment depicted in FIG. 5, the punch 71- comprises a pump 73 with a pump body 74 and a ram 72. An end 79 of the ram 72 is directly rotatably articulated to an intermediate part 76, which itself is directly rotatably articulated to the pump body 74.

The axis U—U of rotation of the ram 72 is inclined with respect to the axis XX of the pump 73 by an angle B, while the axis V—V of rotation of the intermediate part 76 is inclined by an angle C with respect to the axis XX. In this embodiment, the ram 72 is coaxial with the axis XX of the pump 73.

For angular values B=15 degrees and C=30 degrees, rotations of, on the one hand, the ram 72 and, on the other hand, the intermediate part 76, each by 180 degrees, bring the ram from its position coaxial with XX to its position 72*a* in which its axis is perpendicular to the axis XX, or vice versa.

As an alternative, the indexing means for example may be modified. Thus, the indentations 16 may be formed on the ram end 9 and conversely the blind hole 18 is then formed in the pump body 4. It would also be possible to use two appropriately positioned balls 15.

What is claimed is:

1. A hydraulic punch comprising:

a hydraulic ram having an end;

a hydraulic pump connected to said hydraulic ram, said hydraulic pump comprising:

a body, and a reservoir having a longitudinal axis (XX); and a manual operating lever articulated to said body of said hydraulic pump and operable to operate said hydraulic pump, wherein said end of said hydraulic ram has means for directly articulating to said body of said hydraulic pump and said hydraulic ram is rotatable about an axis of rotation (ZZ) which is inclined with respect to the longitudinal axis (XX) of the reservoir.

2. A hydraulic punch according to claim 1, wherein the axis of rotation (ZZ) of said hydraulic ram is inclined by approximately 45 degrees with respect to the longitudinal axis (XX) of the reservoir.

3. A hydraulic punch according to claim 2, wherein said hydraulic ram has a longitudinal axis (YY) and when the longitudinal axis (YY) of said hydraulic ram is in a position parallel to the longitudinal axis (XX) of the reservoir of said hydraulic pump, the longitudinal axis (YY) of said hydraulic ram is laterally offset from the longitudinal axis (XX) of the reservoir of said hydraulic pump.

4. A hydraulic punch according to claim 1, wherein said hydraulic ram further comprises:

a cylinder; and a piston contained in said cylinder.

5. A hydraulic punch according to claim 4, wherein said end of said hydraulic ram comprises a male part having an end, the male part being coaxial with the axis of rotation (ZZ), and said body of said hydraulic pump comprises a female part complementary to the male part and delimiting a housing for the male part, wherein the end of the male part and the housing form a hydraulic chamber coaxial with the axis of rotation (ZZ).

6. A hydraulic punch according to claim 5, wherein the male part comprises:

a cylindrical central stub having a circular cross section and an exterior surface parallel to the axis of rotation (ZZ); and an O-ring fitted to the exterior surface of the cylindrical central stub and operable to seal the hydraulic chamber.

7. A hydraulic punch according to claim 6, wherein:

the male part further comprises:

a shoulder, and a cylindrical wall having a circular cross section concentric with the cylindrical central stub; and wherein said hydraulic punch further comprises an assembly securing said hydraulic ram with said body of said hydraulic pump.

8. A hydraulic punch according to claim 7, wherein said assembly comprises:

grooves adjacently located in said end of said hydraulic ram and in said body of said hydraulic pump; and a ring of balls housed in the grooves.

9. A hydraulic punch according to claim 7, wherein the cylindrical central stub has a diameter that is smaller than a diameter of the cylindrical wall.

10. A hydraulic punch according to claim 4, further comprising:

an axial boss having a central passage, said axial boss located within said end of said hydraulic ram and delimiting an annular housing having an end located within said end of said hydraulic ram;

a spring located in the annular housing and seated on the end of the annular housing, said spring being operable to bias said piston of said hydraulic ram away from said end of said hydraulic ram; and wherein said piston has a guide stem slidably located within the central passage of said axial boss such that the annular housing has a height approximately equal to a height of said spring in a compressed state at an end of a pull stroke, whereby said piston comes into abutment on said axial boss.

11. A hydraulic punch according to claim 1, further comprising an indexing device operable to maintain said end of said hydraulic ram at an indexed angular position of operation with respect to said body of said hydraulic pump.

12. A hydraulic punch according to claim 11, wherein:

the axis of rotation (ZZ) of said hydraulic ram is inclined by approximately 45 degrees with respect to the longitudinal axis (XX) of the reservoir;

said hydraulic ram further comprises:

a cylinder, and a piston contained in said cylinder; and said indexing device comprises:

a blind hole located in one of said end of said hydraulic ram and said body of said hydraulic pump, at least two indentations located in one of said end of said hydraulic ram or said body of said hydraulic pump, said one being free of the blind hole, at least one ball slidably located in the blind hole, and a spring located within the blind hole operable to push said at least one ball into one of the at least two indentations, wherein the at least two indentations are at an angular distance apart such that when said at least one ball is in one of the at least two indentations, said hydraulic ram is substantially parallel to the longitudinal axis (XX) of the reservoir and when said at least one ball is in another indentation of the at least two indentations, said hydraulic ram is substantially perpendicular to the longitudinal axis (XX) of the reservoir.

13. A hydraulic punch according to claim 1, wherein said body of said hydraulic pump is one piece and comprises a lateral lug to which said manual operating lever is articulated.

14. A hydraulic punch according to claim 13, further comprising a piston having a head slidably mounted within said body of said hydraulic pump, wherein said lateral lug comprises an abutment surface on a surface of said lateral lug facing the head of said piston, and wherein the head of said piston abuts against the abutment surface of said lateral lug when said manual operating lever is in a position of maximum separation from said hydraulic pump.

15. A hydraulic punch according to claim 1, wherein said manual operating lever comprises an end yoke, and said hydraulic punch further comprises:

a piston having an oblong slot slidably mounted within said body of said hydraulic pump; and a pivot pin passing through said end yoke of said manual operating lever and the oblong slot of said piston, said pivot pin operable to move along the oblong slot when said manual operating lever is pivoted.

16. A hydraulic punch comprising:

a hydraulic ram having an end;

a hydraulic pump, comprising:

a body, and a reservoir having a longitudinal axis (XX);

an intermediate part located directly between said hydraulic ram and said hydraulic pump and having first and second ends, said first end connected to said end of said hydraulic ram and said second end connected to said body of said hydraulic pump; and a manual operating lever articulated to said body of said hydraulic pump and operable to operate said hydraulic pump, wherein said end of said hydraulic ram is directly articulated to said first end of said intermediate part about a first axis of rotation which is declined with respect to the longitudinal axis (XX) of the reservoir, and said second end of said intermediate part is directly articulated to said body of said hydraulic pump about a second axis of rotation which is inclined with respect to the longitudinal axis (XX) of the reservoir.

* * * * *